United States Patent [19]

Davidoff

[11] 4,011,607

[45] Mar. 15, 1977

[54] SWIMMING POOL COVER

[76] Inventor: Benjamin Davidoff, c/o Alcazar Pool Manufacturing Co., Inc., Irvington-on-Hudson, N.Y. 10533

[22] Filed: Dec. 17, 1975

[21] Appl. No.: 641,760

Related U.S. Application Data

[63] Continuation of Ser. No. 477,441, June 7, 1974, abandoned.

[52] U.S. Cl. ..... 4/172.12; 220/319

[51] Int. Cl.[2] ..... E04H 3/19

[58] Field of Search ..... 4/172.12; 220/319–321, 220/80; 292/256.6; 5/353.1, 353.2, 353.3; 52/60, 63, 96; 135/15 CF; 160/395, 399, 402, 403; 49/466; 217/89

[56] References Cited

UNITED STATES PATENTS

| | | | |
|---|---|---|---|
| 2,146,190 | 2/1939 | Luke | 220/320 X |
| 2,474,158 | 6/1949 | Neely | 5/353.3 X |
| 3,103,083 | 9/1963 | Seeger | 220/319 X |
| 3,273,178 | 9/1966 | Baruth et al. | 5/353.2 |
| 3,373,464 | 3/1968 | Ausnit | 4/172.12 X |
| 3,427,663 | 2/1969 | O'Connell et al. | 52/169 X |
| 3,633,968 | 1/1972 | Sears | 5/353.2 X |
| 3,758,159 | 9/1973 | Morris | 5/353.2 X |

FOREIGN PATENTS OR APPLICATIONS

| | | | |
|---|---|---|---|
| 1,138,322 | 6/1957 | France | 220/319 |

*Primary Examiner*—Charles E. Phillips
*Attorney, Agent, or Firm*—Mandeville and Schweitzer

[57] ABSTRACT

Disclosed herein is a "drumhead" swimming pool cover assembly for a pool of predetermined size and shape having a circumscribing coping including a special male locking lip. The cover assembly includes a sheet of flat, flexible material having dimensions sufficient to allow the cover to drape the edges of the swimming pool coping, and a plurality of extruded plastic locking channels adapted to snap-on and lock to said locking lip along most of the pool periphery and to clamp said cover to said coping in a manner whereby the subsequent top loading of the cover increases the clamping or binding action of the channel and the lip with respect to the interposed cover portions. Advantageously, the coping to which the new drumhead cover is attached is of extruded aluminum construction, while the locking channels themselves are of extruded thermoplastic construction. The sheet material comprising the drumhead may be any known swimming pool cover material, such as impermeable sheet polyethylene, permeable woven polyethylene or the like.

3 Claims, 3 Drawing Figures

SWIMMING POOL COVER

This is a continuation of application Ser. No. 477,441, filed June 7, 1974, now abandoned.

BACKGROUND AND SUMMARY OF THE PRESENT INVENTION

A plethora of patented swimming pool covers have been available for safety purposes and/or preserving the cleanliness of the water in swimming pools during cold seasons when the pool is not in service. The covers, of course, prevent contaminants, such as dirt, leaves, branches, etc., and other foreign matter from entering the water. The prior art covers typically require substantial manufacturing efforts and concomitant high costs occasioned by providing such covers with grommets, straps, ballasting means, mechanical locking devices, thickened borders, draw ropes, and like structure for use in anchoring the cover to the pool or otherwise securing it about the pool periphery.

Typical of such prior art covers are those shown in U.S. Pat. Nos. 3,354,472; 3,355,745; 3,427,663; 3,523,308; 3,593,757; and 3,667,070. All of the prior art covers require substantial manufacturing effort, must be cut to precise sizes, and are difficult to install about and/or anchor to pool structures. Therefore, they are very expensive to manufacture and are costly to the consumer.

In accordance with the present invention, a new and improved drumhead type swimming pool cover may be manufactured simply by cutting any known swimming pool cover material to rough sizes and rough shapes greater than those of the pool to be covered and sufficient for the cover to drape over the edges of the pool in drumhead fashion. The new cover may be fastened to most existing above-ground pools and, indeed, may be fastened to all pools constructed, in accordance with the principles of the present invention, with a coping member provided with a male locking lip of predetermined configuration to be described hereinafter. Typically, the locking lip is in the nature of a curled rail or the like, which extends from a vertical outer wall of the coping and which has a free edge which projects upwardly and outwardly with respect to the pool being covered.

The sheet material comprises the drumhead cover which is clamped securely in place, in accordance with the invention, by an elongated, extruded plastic, snap-on channel member which engages the locking lip around the peripheral portions of the pool and clamps the cover sheet securely therebetween. The internal cross-sectional configuration of the locking channel is substantially congruent with the cross section of the locking lip. In accordance with a more specific principle of the invention, the cooperating configurations of the locking lip and the locking channel are such that the loading of the pool cover after its installation, such as by fallen leaves, the formation of a pool of rain water or melted snow thereupon, will cause the clamping and locking action to be enhanced, with a resultant tightening of the gripping of the cover member to the pool coping.

As a most important advantage of the practice of the present invention, the main component of swimming pool cover assemblies, i.e., the cover sheet, may be manufactured simply and expenditiously by unskilled labor merely by cutting sheet material to size. No labor whatever is required for the installation of grommets, locks, or other anchoring hardware to the cover, nor is any labor or material required to specially shape the cover or its edge portions. Indeed, by the provision of standard, universal, or modular locking channels, which are configured to effectively mate with a wide variety of locking lip configurations, the manufacturing costs of complete swimming pool cover assemblies will be further reduced to a bare minimum.

For a more complete understanding of the present invention and a better appreciation of its attendant advantages, reference may be made to the following detailed description taken in conjunction with the accompanying drawings.

DETAILED DESCRIPTION OF THE INVENTION

Figure 1:
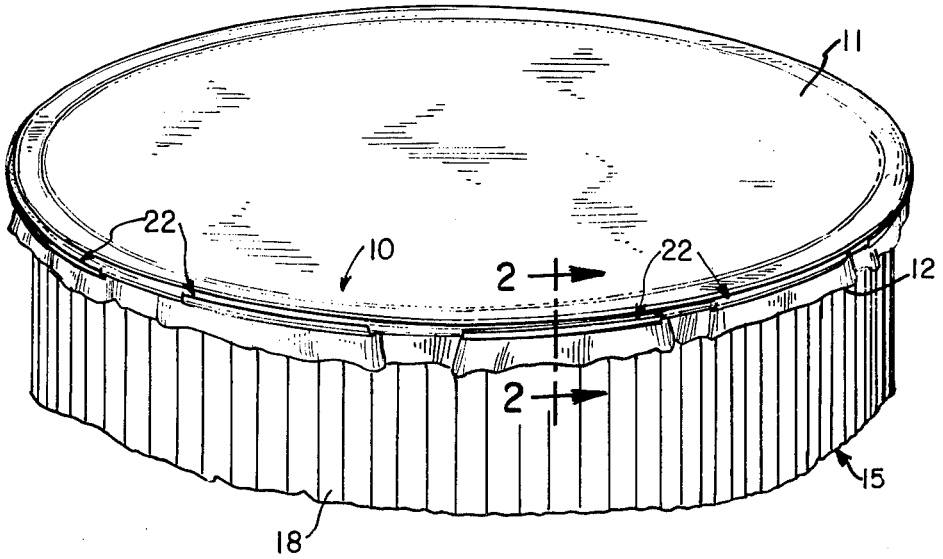
FIG. 1 is a perspective view of the upper portions of an above the ground swimming pool to which a drumhead-type swimming pool cover has been anchored, in accordance with the principles of the present invention.

Referring now to FIG. 1, the new cover assembly 10 of the present invention comprises a cover member 11 having outer edges 12 of any particular configuration, which member 11 is cut to rough dimensions of sufficient size and shape to completely drape the upper periphery of the swimming pool 15, which may be an in-ground or above-ground pool, to which it is to be attached. In accordance with the invention, the pool with which the new cover may be used includes a coping member 16, preferably of the inverted U-shaped extruded aluminum type, having a horizontal web 17, an inner vertical wall portion 18, and an outer vertical wall portion 19, terminating in a locking lip or rail 20. The locking lip 20 includes a bead or curl portion 21 which projects upwardly and outwardly with respect to the uppermost horizontal plane of the pool defined by web 7 of the coping.

Figure 2:
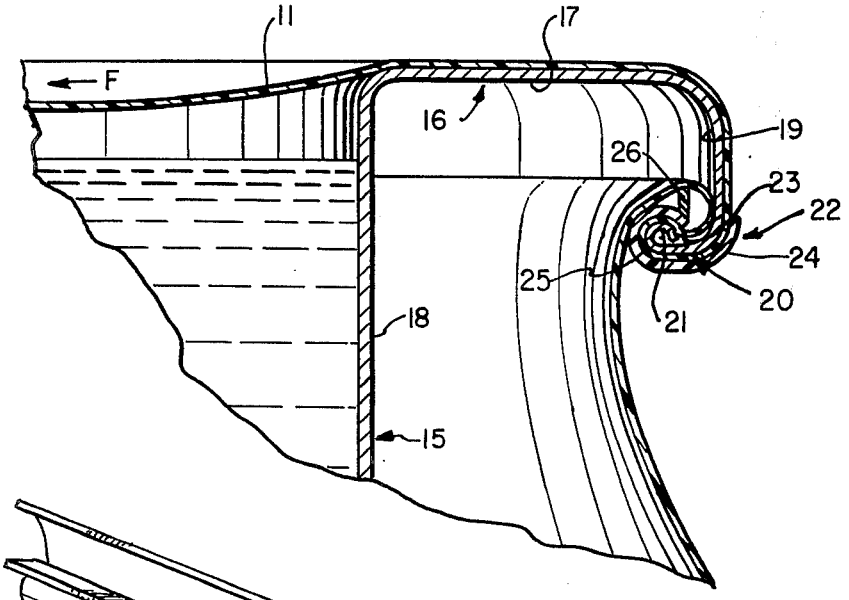
FIG. 2 is an enlarged, cross-sectional view of a cover membrane, coping member and locking channel member cooperatively arranged in accordance with the principles of the present invention.
Figure 3:
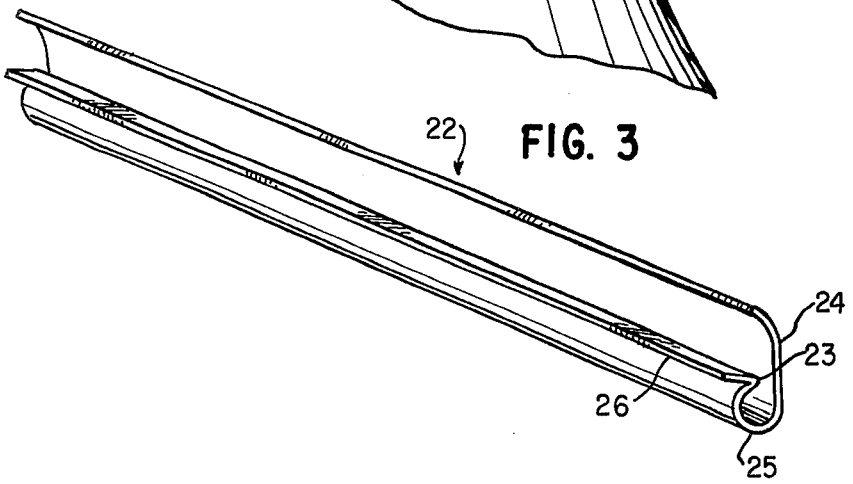
FIG. 3 is a perspective view of the cover locking channel member embodying the principles of the present invention.

In accordance with the invention, the cover sheet 11 includes no hardware, grommets, or any other modifications thereto, and is, therefore, manufactured at barely more than the cost of the material itself. The cover 11 is lockingly clamped to the lip or rail 20 by a unique locking channel member 22. As shown in FIGS. 2 and 3, the locking channel 22 is configured to generally conform to the locking lip 20. Therefore to assemble the channel onto the locking lip 20 the channel 22 must be fixed to snap on to the curb portion 21 of the locking lip 20. More specifically and in accordance with the inventive principles, the locking channel includes a knee portion 23 which is adapted to be engaged adjacent to and near the end of said curl 21. As shown best in FIG. 2, the knee 23 is directed inwardly and downwardly, in its installed position, with respect to the web portion 17. The locking channel 22 is advantageously made of extruded thermoplastic, such as polyethylene, which is durable, strong, resilient and flexible, as well as being economical. The cross section of the extruded channel 22 includes, in addition to the knee 23, a flange portion 24 which joins an arcuate portion 25 which joins at a tail portion 26 at the knee 23. The arcuate portion 25 matingly engages the curl portion 21 of the web 17, with the knee portion 23 engaged near the end of curl portion 21 and the flange portion 24 engaged with a mating portion of the web. It is to be understood, of course, that the specific cross section illustrated is one of many embodiments that may be used to practice the invention; the essential criteria of any preferred embodiments being that the elongated locking channel, in cooperation with the locking lip, clamp a cover sheet 11 therebetween when the locking channel is matingly snapped over the cover member portion which has been drapingly juxtaposed with the locking lip, and that the clamping action be increased by loading of the cover.

The cover material may be any of the well-known cover fabrics, synthetic or otherwise, which are commonly employed in the art for making conventional pool covers. These materials include polyethylene sheet material, polyvinyl chloride sheet material, and the like, or woven synthetic monofilament material, such as polyethylene, polypropylene, or the like, for porous, water-permeable covers.

As shown in FIG. 1, the cover 11 may be secured firmly in place, in accordance with the invention, by utilizing a plurality of channel members 22, which generally circumscribe the entire periphery of the pool 15, and, in no event, engage less than approximately 50% of the perimeter of the pool, as defined by the coping 16. As will be appreciated, the most secure and the strongest locking of the cover 11 to the coping 16 is obtained by having the entire periphery of the coping engaged by channel members, the end edges of which channel members will be abutted. Of course, with many types of swimming pool constructions, there will be buttresses, vertical columns, and other pool support structure, which will necessitate the spacing of the ends of the channel members in a manner analogous to that shown in FIG. 1. In pools of this type, each of the channel members may be cut to extend substantially between adjacent vertical support members of the pool, as will be understood.

It should be appreciated that the swimming pool cover assemblies herein illustrated and described are intended to be representative only, as certain changes may be made therein without departing from the teachings of the disclosure. Accordingly, reference should be made to the following appended claims in determining the full scope of the invention.

I claim:

1. A combination of a snap-on cover assembly and a swimming pool having a perimeter defined by a circumscribing coping, said coping includes a horizontal web portion and a depending vertical wall portion said wall portion terminating in a male locking lip of predetermined cross section, a. said cover assembly comprising a sheet of flexible material of a size sufficient to completely cover said pool and said coping;

b. an elongated female resilient locking channel having an internal cross section generally congruent with said predetermined cross section of said male locking lip;

c. said locking channel including a flange portion and a tail portion interconnected by an arcuate portion and further including a knee portion interconnecting said arcuate and tail portions;

d. said male locking lip including a curl portion;

e. peripheral portions of said cover sheet being adapted to be juxtaposed to said locking lip and tightly clamped thereto by the snap-on placement of said locking channel thereover whereby said arcuate portion engages said male locking lip around said curl portion with said knee portion engaged adjacent and near the end of said curl portion and the flange portion matingly engaging a portion of said web wherein said cover will be securely locked in place by the mating of said channel with said lip with the peripheral cover portions interposed; and f. whereby increased inwardly directed tensioning of said cover caused by the loading of the same will increase the degree of clamping of said cover to said coping.

2. The cover assembly of claim 1, in which a. said locking lip is formed as an integral element of an extruded coping member;

b. said channel is an extruded thermoplastic member and is flexible and resilient.

3. The cover assembly of claim 1, in which a. said coping is extruded aluminum;

b. said channel is extruded polyethylene.

* * * * *